United States Patent [19]

Ramsey

[11] 4,156,410

[45] May 29, 1979

[54] INTERNAL COMBUSTION RECIPROCATING ENGINE

[75] Inventor: Charles R. Ramsey, Dunkirk, Ind.

[73] Assignee: Ran-Z, Inc., Dunkirk, Ind.

[21] Appl. No.: 816,375

[22] Filed: Jul. 18, 1977

[51] Int. Cl.[2] ..... F01L 11/02; F02B 59/00

[52] U.S. Cl. ..... 123/47 A; 123/41.35; 123/50 R; 123/54 B; 123/56 AB; 123/71 R; 123/74 A

[58] Field of Search ..... 123/47 R, 47 A, 41.35, 123/54 R, 54 B, 56 R, 56 AB, 56 BB, 61 R, 62, 66, 50, 71 R, 74 A, 74 C, 74 AE

[56] References Cited

U.S. PATENT DOCUMENTS

| | | | |
|---|---|---|---|
| 864,586 | 8/1907 | Wottring | 123/47 R |
| 1,425,054 | 8/1922 | Ricardo | 123/41.35 |
| 2,319,427 | 5/1943 | Morgan | 123/47 R |
| 3,177,853 | 4/1965 | Hendershot | 123/47 R |
| 3,398,728 | 8/1968 | Hardman | 123/56 BC |

FOREIGN PATENT DOCUMENTS

| | | | |
|---|---|---|---|
| 619197 | 3/1927 | France | 123/66 |
| 1078641 | 11/1954 | France | 123/47 A |

*Primary Examiner*—Charles J. Myhre

*Assistant Examiner*—Craig R. Feinberg

*Attorney, Agent, or Firm*—Gust, Irish, Jeffers & Rickert

[57] ABSTRACT

An internal combustion engine having a housing defining a pair of axially aligned and opposing cylinders with a lubricant chamber therebetween, a stationary piston in the housing extending through the lubricant chamber and having opposite ends disposed within the aligned cylinders, and a hollow cylindrical piston slidably received within the housing and around the stationary piston for reciprocal movement thereby forming a pair of first variable volume chambers between it and the aligned cylinders and a pair of second variable volume chambers between it and the stationary piston. A carburetor communicates with the second chambers through longitudinal passageways in the stationary piston so as to admit a charge of combustible fuel therein which is compressed and then injected into the first chambers for recompression and subsequent combustion, the compression and combustion cycles for the chambers on opposite ends being 180° out of phase. Lubrication for the sliding surfaces between the pistons and the moveable piston and cylinders is accomplished by means of ports which extend through the piston from the crankcase to the stationary piston.

16 Claims, 4 Drawing Figures

INTERNAL COMBUSTION RECIPROCATING ENGINE

BACKGROUND OF THE INVENTION

Field of the Invention

The present invention relates to a reciprocating internal combustion engine and particularly to an engine of the two-cycle type.

One of the primary problems of small two cycle engines is the difficulty in providing adequate lubrication, and for this reason it has often been necessary to mix oil with the gasoline. Although this assures some degree of lubrication between the sliding surfaces of the piston and cylinder, it adds a significant amount of contaminants to the fuel which prevents clean burning thereof and causes the exhaust to be quite smoky.

A further problem with many prior art two cycle engines is the difficulty in accomplishing good scavenging of the exhaust gases prior to compression of the fresh charge. If too great a portion of the exhaust gases remain in the combustion chamber, a loss of power will result. On the other hand, if a portion of the fresh charge is vented to the atmosphere during scavenging, this will reduce fuel economy and also develop pollutants.

One example of a prior art engine which is related to the present invention is disclosed in U.S. Pat. Nos. 2,319,427 and 2,385,457. The engine is basically a two cylinder reciprocating engine having opposing cylinders on either side of a power transmitting mechanism with reciprocating pistons received therein and auxiliary compression chambers formed between a pair of stationary pistons and the aforementioned moveable pistons. The fuel is initially compressed in the auxiliary chamber and then admitted to the primary combustion chambers through a back pressure valve and around a deflector plate for the purpose of scavenging the combustion chamber of the exhaust gases and supplying it with a fresh charge of fuel for subsequent compression and ignition.

A further example of prior art two stroke internal combustion engines comprises a single cylinder with a pair of coaxial pistons one of which is free floating, as disclosed in U.S. Pat. No. 1,756,354 to Heibig. In this engine, the fuel/air mixture is drawn into the chamber formed between the two moveable pistons, compressed therein and then injected into the combustion chamber from which the exhaust gases had previously been vented by means of a mechanically opened exhaust valve. Compression and ignition then occurs and the entire cycle is repeated.

SUMMARY OF THE INVENTION

The internal combustion engine of the present invention comprises a stationary cylinder, a stationary inner piston within the cylinder, and an array of exhaust ports for the cylinders circumferentially arranged therearound, a moveable piston having compression and power strokes received in the cylinder and disposed over the stationary piston for reciprocating sliding movement relative to the cylinder and stationary piston and forming a first variable volume chamber with the cylinder and a second variable volume chamber with the stationary piston; the moveable piston comprises means for decreasing the volume of the second chamber and simultaneously increasing the volume of the first chamber on its power stroke, and increasing the volume of the second chamber and simultaneously decreasing the volume of the first chamber on its compression stroke, the moveable piston further having means for opening the exhaust ports during and near the end of the power stroke and closing the exhaust ports during and near the beginning of the compression stroke; also provided are means for admitting a charge of fuel to the second chamber during the compression stroke and means in the moveable piston for injecting a column of fuel directly into the center of the first chamber along the axis of concentricity of the moveable piston and cylinder, said last mentioned means including a valved fluid passage between the first and second chambers.

It is an object of the present invention to provide an internal combustion engine of the two-cycle type wherein the fuel/air charge is injected into the combustion chamber in such a manner that efficient scavenging of the exhaust gases is achieved without substantial loss of the uncombusted fuel mixture.

Another object of the present invention is to provide an internal combustion engine of the two-cycle type wherein the injection of fuel serves to maintain the injection nozzle and spark plug free from contaminants and carbon build-up.

A further object of the present invention is to provide an internal combustion engine having circumferentially arranged exhaust ports which are opened by the moveable piston very near the end of its power stroke so as to permit effective exhausting of the spent gases without sacrificing efficient operation of the engine.

Yet another object of the present invention is to provide an internal combustion engine wherein lubricating of the sliding surfaces is achieved in a simple and effective manner without the necessity for auxiliary oil pumps or the addition of oil to the fuel.

Another object of the present invention is to provide an internal combustion engine employing a pair of axially opposed pistons wherein the force of combustion acting on one piston is transmitted directly to the other on the compression stroke of the latter. This arrangement cushions the piston travel at the end of its power stroke and eliminates the need for a crankshaft and connecting rod assembly to achieve charge compression for the other cylinder. Also, it aids in changing the direction of piston travel.

A still further object of the present invention is to provide an internal combustion engine wherein the reciprocating piston is supported between internal and external stationary members and wherein the fuel charge is supplied to the combustion and compression chambers internally such that greater strength and economy of construction are realized.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
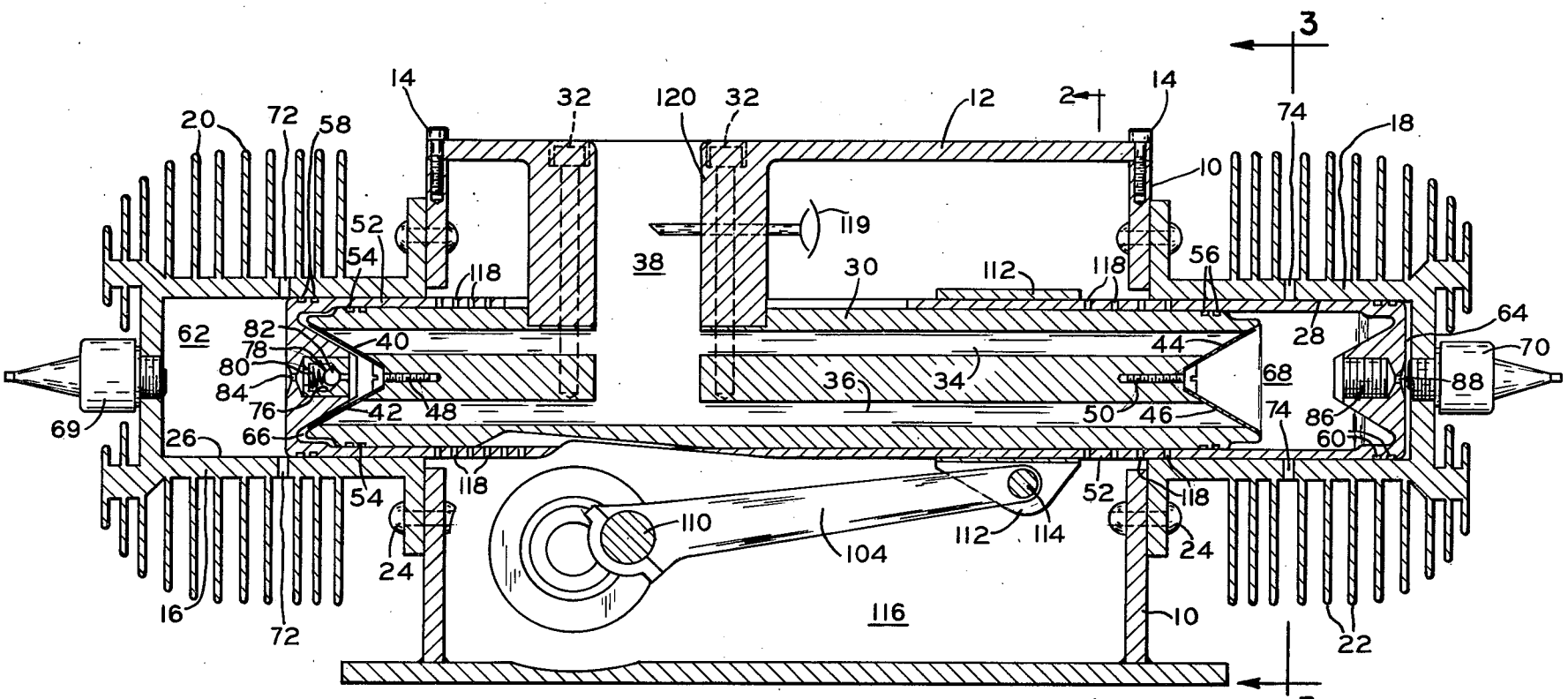
FIG. 1 is a longitudinal sectional view of a preferred embodiment of the invention.
Figure 2:
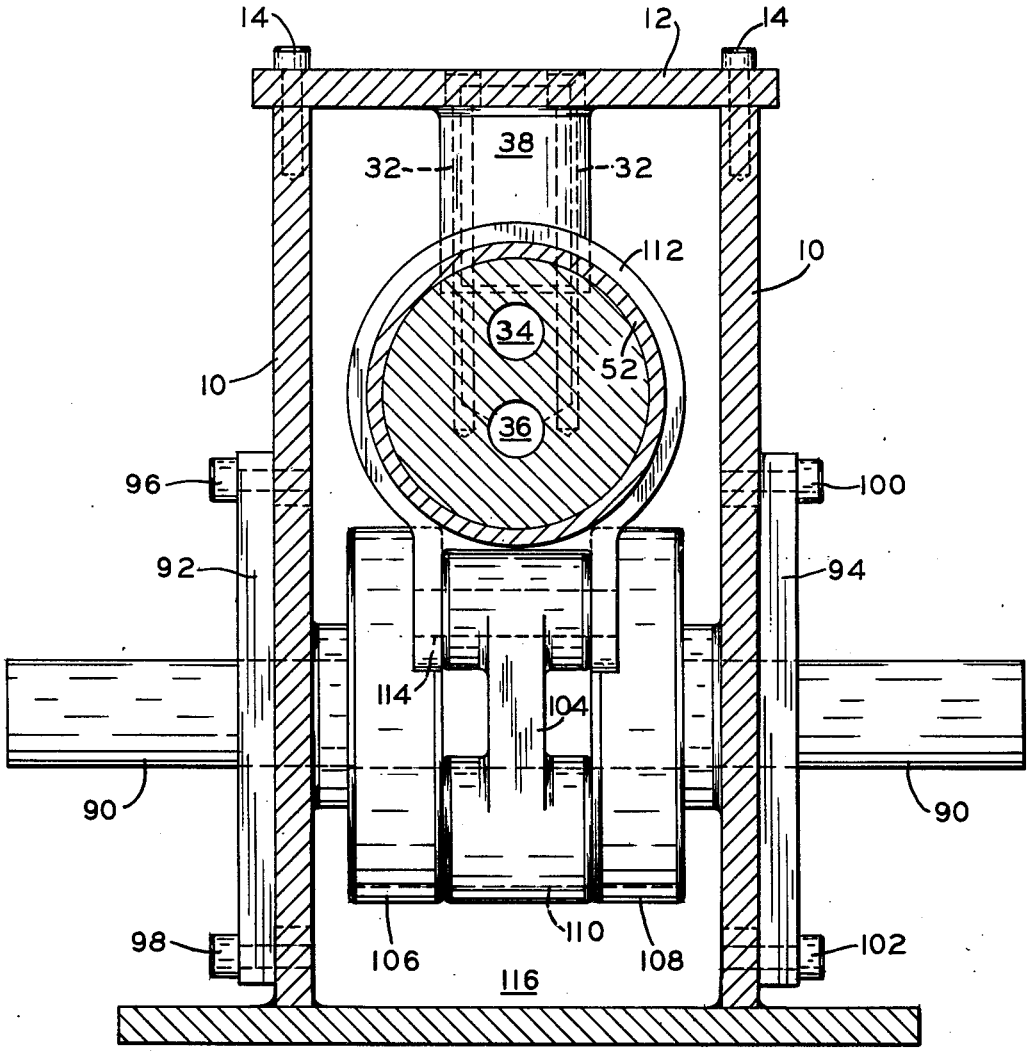
FIG. 2 is a transverse sectional view taken along line 2—2 of FIG. 1 and viewed in the direction of the arrows.
Figure 3:
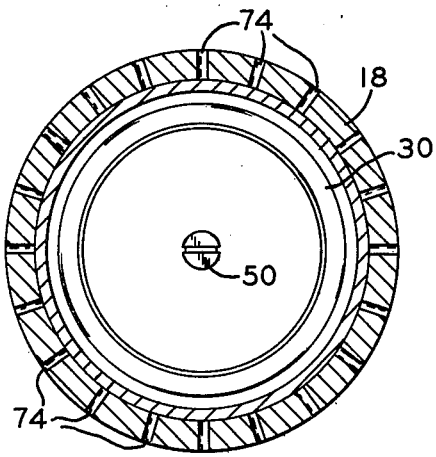
FIG. 3 is a transverse sectional view taken along line 3—3 of FIG. 1 and viewed in the direction of the arrows.

With reference to the drawings, 10 refers to the engine housing which includes a cover 12 secured thereto by means of screws 14. A pair of opposing cylinders 16 and 18, having cooling fins 20 and 22, are attached to housing 10 by screws 24 such that their bores 26 and 28 are coaxial.

Received within housing 10 and cylinders 16 and 18 is a stationary internal piston 30 which is rigidly secured to housing cover 12 by means of four screws 32. Stationay piston 30 includes a pair of vertically spaced parallel fluid passages 34 and 36 which lead from the carburetor throat 38 formed in cover 12 to the opposite ends of piston 30 and are opened and closed by reed valves 40, 42, 44 and 46 which are resiliently biased against piston 30 such that they open when the pressure within pasages 34 and 36 is sufficiently greater than the pressure on opposite sides of the valves 40, 42, 44 and 46 to overcome their inherent resiliency. Screws 48 and 50 retain the valves 40, 42, 44 and 46 in place.

Slidably received within cylinders 16 and 18 and over stationary piston 30 is an elongated cylindrical moveable piston 52 which is concentric with respect to cylinders 16 and 18 and piston 30. By virtue of piston rings 54, 56, 58 and 60, fluid-tight variable volume chambers are formed between piston 52, cylinders 16 and 18 and moveable piston 52. Specifically, a combustion chamber 62 is formed between cylinder 16 and moveable piston 52 at one end of the engine and a second combustion chamber 64 is formed between cylinder 18 and moveable piston 52 at the other end of the engine. A first compression chamber 66 is formed internally of piston 52 between it and one end of stationary piston 30, and a second compression chamber 68 is formed internally of moveable piston 52 between it and the other end of stationary piston 30. Spark plugs 69 and 70 or other suitable ignition devices extend into combustion chambers 62 and 68, respectively. A plurality of circumferentially arranged exhaust ports 72 extend through cylinder 16 and similarly positioned exhaust ports 74 extend through cylinder 18.

Leading from compression chamber 66 into combustion chamber 62 is a fluid passageway 76 provided with a check valve 78 which will open when the pressure within compression chamber 66 is sufficiently greater than the pressure within combustion chamber 62 to overcome the resiliency of spring 80 which seats ball 82. A nozzle 84 serves to disperse the air/fuel mixture as it enters combustion chamber 62. A similar passageway and check valve 86 controls the passage of fluid from compression chamber 68 into combustion chamber 64 and is also provided with a nozzle 88.

A crankshaft 90 is mounted within the lower portion or oil pan 116 of housing 10 through bearings 92 and 94 which are fastened to housing 10 by means of screws 96, 98 and 100, 102, respectively. Connecting rod 104 connects to crankshaft throws 106 and 108 through pin 110 and to moveable piston 52 by means of connecting clamp 112, which encircles piston 52, and pin 114.

Oil pan 116 contains a quantity of lubricating oil which is splashed around piston 52 as the crankshaft 90 rotates. The lubricating oil is carried to stationary piston 30 and the internal surfaces of cylinders 16 and 18 by means of a plurality of oil ducts 118 which extend through piston 52. In this manner, the entire engine housing 10 serves the function of a crankcase to lubricate the sliding surfaces between the moveable piston 52, stationary piston 30, and cylinders 16 and 18.

OPERATION

Assume initially that the moveable piston 52 is in the position shown in FIG. 1 and that spark plug 70 has just fired thereby igniting the compressed air/fuel mixture in combustion chamber 64. When this mixture is ignited, it will drive piston 52 to the left. Since the pressure caused by the exploding mixture in combustion chamber 64 will be greater than the pressure in compression chamber 68, check valve 86 will be closed and the fresh air/fuel mixture in chamber 68 will be compressed as chamber 68 decreases in volume. At the same time, the opposite end of piston 52 will be driven to the left thereby compressing the fresh air/fuel mixture within combustion chamber 62 and causing compression chamber 66 to expand in volume as it moves away from stationary piston 30. Since the pressure within combustion chamber 62 is greater than the pressure in compression chamber 66 because of the compresssion of the gases prior to ignition, check valve 78 will be seated thereby creating a vacuum within compression chamber 66 which will draw an air/fuel charge from carburetor 120 through passages 34 and 36 in the direction of the arrows. The vacuum in compression chamber 66 causes reed valves 40 and 42 to open thereby admitting the fresh fuel/air charge into chamber 66.

Returning now to cylinder 18, as piston 52 is driven to the left, it will clear exhaust ports 74 at or very near the end of its power stroke thereby permitting the spent gases to vent to the atmosphere. When this occurs, the pressure within combustion chamber 64 drops substantially below the pressure within compression chamber 68, which by this time has increased due to the compression of the air/fuel charge. This causes check valve 86 to unseat and permits the compressed charge to be injected into combustion chamber 64 through nozzle 88.

Figure 4:
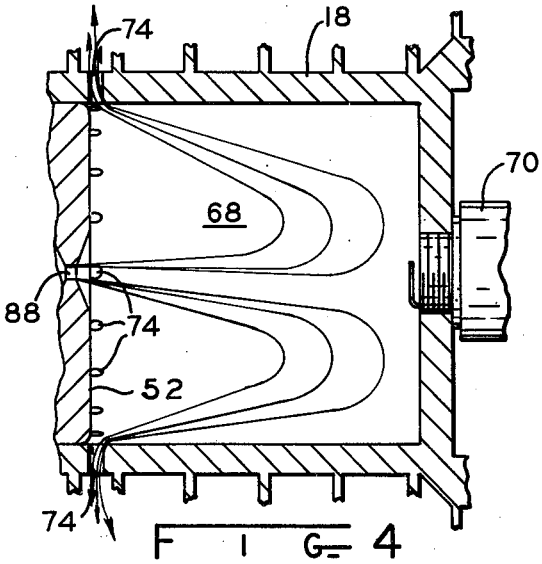
FIG. 4 is an enlarged fragmentary sectional view of one of the combustion chambers showing the charge injection pattern.

The central positioning of nozzle 88 and the circumferential arrangement of exhaust ports 74 is important in that it produces an injection pattern for the air/fuel charge which is umbrella-shaped, as shown in FIG. 4. It has been found that an injection pattern of this type, where the fresh charge pushes the exhaust gases before it and out the exhaust ports 74, is very effective in scavenging the combustion chamber of the spent gases with minimum loss of the uncombusted charge. Furthermore, the injection of the air/fuel charge through the nozzle 88 at a relatively high velocity serves to maintain the nozzle 88 free from carbon build-up and other matter which would interfere with fuel injection. By directing the fresh charge directly at the spark plugs 69 and 70, it assures that a combustible atmosphere is in intimate contact with the plugs 69 and 70 when they fire and also assists in preventing carbon build-up. By locating the exhaust ports 72 and 74 at or near the end of the piston power stroke, more complete scavenging may be achieved yet exhaust does not occur until maximum power from the exploding charge has been obtained.

As cylinder 18 is being scavenged and the new charge is injected through nozzle 88, spark plug 69 will fire thereby igniting the air/fuel charge which has been compressed in combustion chamber 62. This will drive piston 52 to the right, compressing the air/fuel charge which was previously drawn into compression chamber 66 and compressing the air/fuel charge which was just injected into combustion chamber 64.

In this manner, cylinders 16 and 18 are alternately fired 180° out of phase and the reciprocating motion of piston 52 is transmitted to crankshaft 90 through connecting rod 104. Because compression of the charges, whether in the combustion chambers 62 and 64 or the compression chambers 66 and 68 always occurs through the direct transmission of force from a firing cylinder, the need for flywheels and other momentum maintaining elements is minimized. This serves to both reduce the weight and bulk of the engine and permits its construction to be greatly simplified.

Desireably, the chamber of oil pan 116 is vented to the low pressure side of the carburetor or engine intake by means of a venting tube 119. This serves to inhibit lubricating oil from exuding into the combustion chambers from such chamber.

While there have been described above the principles of this invention in connection with specific apparatus, it is to be clearly understood that this description is made only by way of example and not as a limitation to the scope of the invention.

What is claimed is:

1. An internal combustion engine comprising:

a stationary cylinder, a stationary two headed inner piston concentrically disposed within said cylinder, an array of exhaust ports for said cylinder circumferentially arranged therearound, a moveable hollow two headed piston having compression and power strokes received in said cylinder and disposed over said stationary piston for reciprocating sliding movement relative to said cylinder and said stationary piston, and each head of said moveable piston forming a first variable volume chamber with said cylinder and a second variable volume chamber with each respected head of said stationary piston, said moveable piston comprising means for decreasing the volume of said second chamber and simultaneously increasing the volume of said first chamber on its power stroke, and increasing the volume of said second chamber and simultaneously decreasing the volume of said first chamber on its compression stroke, said moveable piston further having means for opening said exhaust ports during and near the end of its power stroke and closing said exhaust ports during and near the beginning of its compression stroke, means for admitting a charge of fuel to said second chamber during said compression stroke, means in said moveable piston for injecting a column of fuel directly into the center of said chamber along the axis of concentricity of said moveable piston and cylinder, said means for injecting including a valved orifice between said first and second chambers, a sparking device in said first chamber on said axis of concentricity, said injecting means being in the form of a nozzle which opens without interference directly at said sparking device.

2. An internal combustion engine comprising:

a stationary cylinder, a stationary two headed inner piston concentrically disposed within said cylinder, moveable hollow two headed piston means received in said cylinder for reciprocating sliding movement relative to said cylinder and said stationary piston for forming a first variable volume chamber with said cylinder and a second variable volume chamber between each moveable piston means head and each head of said stationary piston whereby when said first chamber is increasing in volume, said second chamber is decreasing in volume and vice versa, means for providing a charge of fuel, a first fluid passage in the heads of said stationary cylinder leading from said charge forming means to said second chamber, a second fluid passage in the heads of said moveable piston means leading from said second chamber to said first chamber, said second passage including nozzle means for injecting an undeflected column of fuel into the center of said first chamber along the axis of concentricity of said moveable pistion means and said cylinder, a sparking device in said first chamber on said axis, a plurality of exhaust ports in said cylinder arranged circumferentially about said first chamber, first valve means for opening said first passage when the pressure therein exceeds the pressure in said second chamber by a given amount and closing said first passage when the pressure therein is less than the pressure in said second chamber, second valve means for opening said second passage to inject fuel through said nozzle when the pressure in said second chamber exceeds the pressure in said first chamber by a given amount and closing said second passage when the pressure therein is less than the pressure in said first chamber.

3. For use in an internal combustion engine, apparatus comprising a frame which carries two spaced apart axially aligned opposed cylinders, each cylinder having a wall provided with a piston bore and a head closing the bore, an elongated stationay piston having opposite ends and carried by said frame, said stationary piston being disposed within the space defined by said cylinders and radially spaced therefrom, the opposite ends of said stationary piston being axially spaced from the heads of the respective cylinders, a moveable piston interposed in the space between said stationary piston and said cylinders with the opposite end portions thereof reciprocably slidably engaging said bores, respectively, said moveable piston also reciprocably slidably engaging said stationary piston and having heads on the opposite ends thereof, each piston head defining first and second variable volume chambers with the respective end of said stationary piston and the respective cylinder head, said stationary piston having a passage extending between the ends thereof, first valve means on said stationary piston for controlling fuel flow from said passage to the respective first chambers as defined between the ends of said stationary piston and the respective piston heads, means providing a fuel intake which extends transversely of said moveable piston and communicates with said passage, said piston heads each having an orifice therethrough, second valve means engageable with each orifice for controlling fuel flow between respective first and second chambers, fuel-igniting means mounted in each cylinder head, means for lubricating the engaged portions of said moveable piston, said stationary piston and said cylinder bores, means for exhausting gases from said second chambers upon predetermined movement of said piston heads from the respective cylinder heads, said second valve means closing the respective orifices when the gaseous pressure in said second chambers is greater than that in the first chambers, respectively, and opening such orifices in response to said predetermined movement of said piston heads whereby compressed fuel in the first chambers will flow into the second chambers, respectively, said first valve means closing communication between the first chambers and said passage, respectively, when the pressure in the first chambers exceeds that in said passage as a result of the piston heads moving toward the respective ends of said stationary piston and opening communication when the pressure in said passage exceeds that in said first chambers as a result of the piston heads moving away from the respective ends of said stationary piston, and means for converting reciprocatory motion of said moveable piston into rotary motion.

4. The apparatus of claim 3 wherein said orifices are in the form of nozzles centrally located in the respective piston heads, said igniting means being mounted centrally of the respective cylinder heads axially opposite the respective orifices, said exhausting means including a plurality of circumferentially spaced ports in the walls of said cylinders disposed a predetermined distance from the respective cylinder heads whereby the gaseous products of combustion may be exhausted from said second chambers, respectively, when the piston heads retract from said cylinder heads sufficiently to clear said ports.

5. The apparatus of claim 3 wherein said moveable piston is of essentially uniform diameter from end to end, said lubricating means including a plurality of apertures through the wall of said moveable piston which conduct liquid lubricant to the slidably engaged surfaces of said moveable and stationary pistons and a chamber which carries liquid lubricant and which is in communication with said apertures.

6. The apparatus of claim 5 wherein said converting means includes a crank shaft inside said chamber having a connecting rod connected between said moveable piston and said crank shaft, the mid-portion of said moveable piston being substantially surrounded by said chamber.

7. The apparatus of claim 3 wherein said first valve means includes first and second valves on opposite ends of said stationary piston which are resiliently urged to close the respective openings of said passage into said first chambers, and said second valve means includes third and fourth valves resiliently urged to close the respective orifices.

8. The apparatus of claim 7 wherein said cylinder bores are of equal diameter and said moveable piston is hollow and of substantially uniform diameter from end to end.

9. The apparatus of claim 8 wherein said stationary piston is of cylindrical shape and of substantially uniform diameter from end to end, the inner periphery of said moveable piston slidably fitting the exterior of said stationary piston to provide a fluid seal therebetween.

10. The apparatus of claim 9 wherein said lubricating means includes apertures through the wall of said moveable piston which for one position of said moveable piston extend between said bores and said stationary piston and for another position are clear of said bores, and means for providing liquid lubricant to said apertures when they are clear of said bores.

11. The apparatus of claim 9 wherein said lubricating means includes apertures through the wall of said moveable piston, said lubricating means including a chamber containing liquid lubricant, said chamber communicating with said apertures.

12. The apparatus of claim 11 wherein said intake includes a duct extending transversely of said moveable and stationary pistons, said duct connecting to said passage at a point between the ends thereof.

13. The apparatus of claim 12 wherein said first and second valves are spring reed valves overlying the respective ends of said passage, and said third and fourth valves are ball valves spring biased to close the respective orifices.

14. The apparatus of claim 12 wherein said orifices are centrally located in the respective piston heads and of such size as to be in nozzle form, said igniting means being spark plugs mounted centrally of the respective cylinder heads and axially opposite said orifices, respectively, said exhausting means including a plurality of circumferentially spaced ports in the walls of said cylinders disposed a predetermined distance from the respective cylinder heads whereby the gaseous products of combustion may be exhausted from said second chambers, respectively, when the piston heads retract from said cylinder heads sufficiently to clear said ports.

15. The apparatus of claim 14 wherein said moveable piston has a full reciprocatory stroke wherein each piston head moves from a first position immediately adjacent the respective cylinder head and a maximum distance from the adjacent end of said stationary piston where said exhaust ports are covered to a second position immediately adjacent the respective end of said stationary piston and a maximum distance from the respective cylinder head where said exhaust ports are uncovered.

16. The apparatus of claim 15 wherein each end of said piston has a frusto-conical recess through which said passage opens, said first and second valves being reed valves, each reed valve being mounted in said recess to cover the passage opening, each said piston head has a frusto-conically shaped boss which complements and is received by said recess, said boss having a chamber porvided with a valve port which defines a seat and a ball valve in said chamber engaged therewith, a helical spring in said chamber engaged with and urging said ball valve into sealing engagement with said valve port, and each piston head orifice communicating with the respective chamber, and each piston head orifice being of nozzle form and serving to direct a charge of combustible gas directly toward said spark plug.

* * * * *